US007806447B2

(12) United States Patent
Reeb

(10) Patent No.: US 7,806,447 B2
(45) Date of Patent: Oct. 5, 2010

(54) LOCKING DEVICE FOR WASTE CONTAINER

(76) Inventor: David L. Reeb, 8558 Black Star Cir., Columbia, MD (US) 21045

( * ) Notice: Subject to any disclaimer, the term of this patent is extended or adjusted under 35 U.S.C. 154(b) by 287 days.

(21) Appl. No.: 11/853,104

(22) Filed: Sep. 11, 2007

(65) Prior Publication Data

US 2009/0066092 A1 Mar. 12, 2009

(51) Int. Cl.
*E05B 39/02* (2006.01)
*E05C 3/12* (2006.01)

(52) U.S. Cl. ..... 292/205; 292/148; 292/230; 292/231; 292/238; 220/315; 220/908

(58) Field of Classification Search ..... 220/315, 220/908; 292/148, 205, 230, 231, 238
See application file for complete search history.

(56) References Cited

U.S. PATENT DOCUMENTS 4,844,113 A * 7/1989 Jones ..... 137/39
5,094,358 A 3/1992 Serio, Sr.
5,149,153 A 9/1992 Drewry et al.
5,152,562 A * 10/1992 Stevenson et al. ..... 292/252
5,201,434 A 4/1993 De Vivo et al.
5,213,382 A 5/1993 Dawdy et al.
5,224,743 A 7/1993 Dawdy et al.
5,224,744 A 7/1993 Michelutti
5,388,876 A 2/1995 Saincome
5,415,314 A 5/1995 McCollum
5,419,598 A 5/1995 Kreitzer
5,474,341 A 12/1995 Putman et al.
5,490,606 A * 2/1996 Lombardo ..... 220/324
5,599,050 A 2/1997 Tinsley
5,662,364 A 9/1997 Reeb et al.
5,683,126 A 11/1997 De Vivo et al.
5,697,655 A * 12/1997 Strong ..... 292/230
5,997,052 A 12/1999 Reeb et al.
6,290,093 B1 * 9/2001 Obriot et al. ..... 220/835
6,382,688 B1 * 5/2002 Agostini ..... 292/336.3
6,550,827 B1 * 4/2003 Tsujino ..... 292/252
6,666,485 B1 12/2003 Moret
6,733,053 B2 5/2004 Hodge et al.
6,802,550 B1 * 10/2004 Griggs et al. ..... 296/24.34
6,808,080 B2 10/2004 Spiers et al.
6,851,288 B2 2/2005 Howes
7,234,327 B2 6/2007 Howes
7,506,902 B2 * 3/2009 Sheng et al. ..... 292/131

OTHER PUBLICATIONS

Prior art document of Dumpster Lock.

* cited by examiner

*Primary Examiner*—Carlos Lugo
(74) *Attorney, Agent, or Firm*—Berenato & White, LLC

(57) ABSTRACT

A gravity actuated locking device for a container having a hinged lid, comprises a base unit adapted to be fixed to the container and a pivoting unit pivotally mounted to the base unit. The pivoting unit includes a locking mechanism mounted therein for rotation about the base unit. In turn, the locking mechanism comprises a circular rolling member that translates from a blocking position preventing relative movement between the pivoting unit and the base unit to a release position permitting relative movement between the pivoting unit and the base unit.

20 Claims, 11 Drawing Sheets

LOCKING DEVICE FOR WASTE CONTAINER

BACKGROUND OF THE INVENTION

1. Field of the Invention

The present invention generally relates to waste containers and, more particularly, relates to a safety locking device for waste containers.

2. Description of the Prior Art

As is well known, waste containers, such as refuse dumpsters for use in residential and industrial applications, typically include a container supported on a base structure. With the advent of mechanized trash removal, there have been created a number of large sized trash bins or dumpster containers. These containers usually comprise a block-shaped or pyramid-shaped container with a hinged lid attached to one side thereof. The container further includes attachments for accommodating various forked lifting mechanisms of the trash removal vehicle. The containers are lifted by the lifting mechanism of the trash removal vehicle and pivoted in some fashion so that the hinged top of the container opens and the trash contained therein is emptied into the vehicle. The container is then returned to a position on the ground, and the hinged lid closes on top of the container. Many of these large trash receptacles are rented from a trash removal service. These receptacles are not provided free of charge, and consequently their frequent emptying and service can become a considerable expense. This expense is increased when unauthorized users of the receptacle freely deposit trash therein. This unauthorized use necessitates a more frequent emptying of the container, and of course the unauthorized user does not contribute to the increased expense.

In order to reduce the added expense that comes from unauthorized use, the dumpsters must be locked. While conventional chains and padlocks reduce unauthorized dumpster use, they also add to operating expenses because the driver of the truck emptying the dumpster must get out of the truck to unlock the padlock on the dumpster. In the early 1990's, companies began the development and marketing of dumpster locking mechanisms that open automatically when the dumpster is lifted and inverted to dump the trash into the truck. With such as automatic lock, the driver is not required to leave the truck which saves the trash company hundreds of dollars each year.

Conventional automatic locks are typically bulky, expensive and difficult to mount to multiple containers. Since container come in a variety of shapes and sizes, it is important that the locking device be sized and shaped to be retro fit onto a variety of existing containers. Moreover, the locking device must be able to withstand the rigors of everyday, outdoor use in the waste environment.

The need therefore exists for an automatic locking device that improves upon prior automatic locking devices and solves the problems inherent in known automatic locking devices.

SUMMARY OF THE INVENTION

According to the principles of the present invention, a gravity actuated locking device for a container is provided. The container is movable between an upright storing position and a tilted dumping position. The locking device comprises a base unit adapted to be fixed to the container and a pivoting unit pivotally mounted to the base unit. The pivoting unit includes a locking mechanism mounted therein for rotation about the base unit. In turn, the locking mechanism comprises a circular rolling member that translates from a blocking position preventing relative movement between the pivoting unit and the base unit to a release position permitting relative movement between the pivoting unit and the base unit.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

Other objects and advantages of the present invention will become apparent from a study of the following specification when viewed in light of the accompanying drawings, wherein.

DETAILED DESCRIPTION OF PREFERRED EMBODIMENTS

Figure 1:
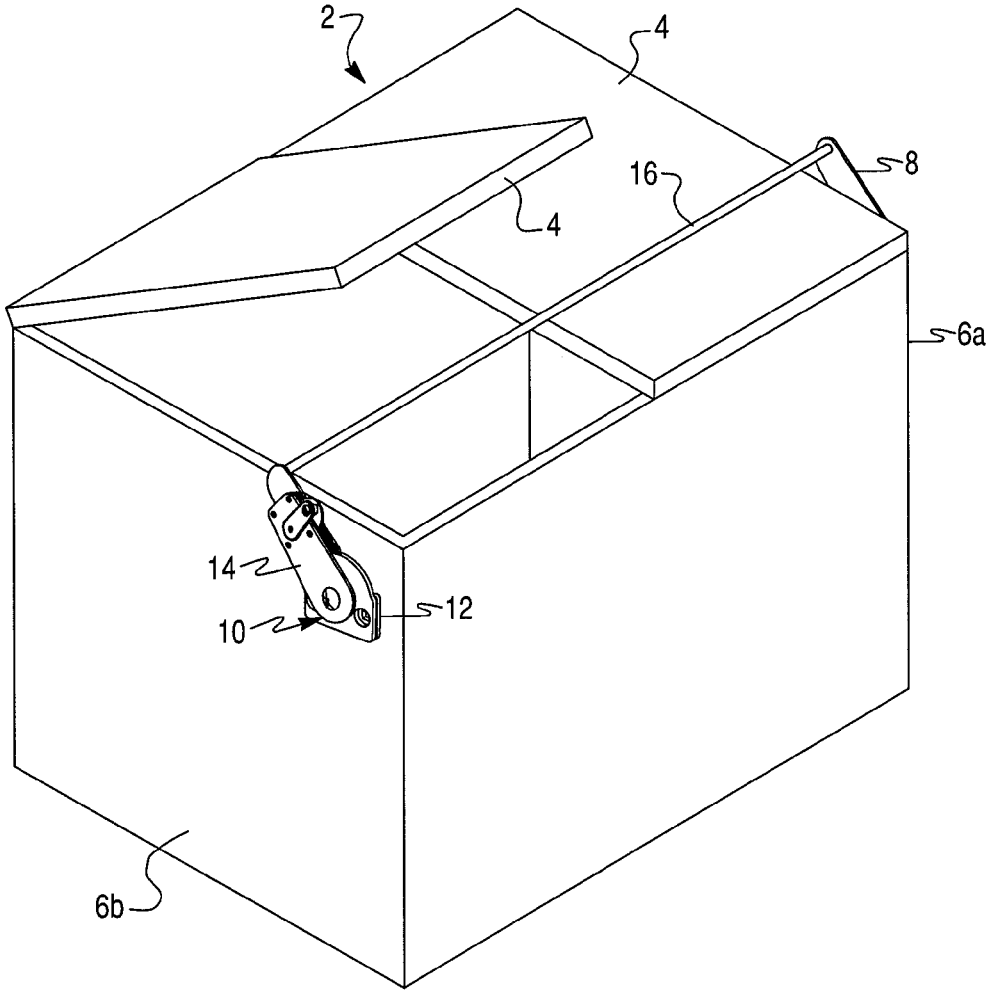
FIG. 1 is a perspective view of a waste container with a locking device according to the present invention, shown in a closed position.

The preferred embodiment of the present invention will now be described with the reference to accompanying drawings. The following description of the preferred embodiment is merely exemplary in nature and is in no way intended to limit the invention, its application, or uses.

For purposes of the following description, certain terminology is used in the following description for convenience only and is not limiting.

The characterizations of various components and orientations described herein as being "vertical", "horizontal", "upright", "right", "left", "side", "top", or "bottom" designate directions in the drawings to which reference is made and are relative characterizations only based upon the particular position or orientation of a given component as illustrated. These terms shall not be regarded as limiting the invention. The words "downward" and "upward" refer to position in a vertical direction relative to a geometric center of the apparatus of the present invention and designated parts thereof. The terminology includes the words above specifically mentioned, derivatives thereof and words of similar import. Additionally, the word "a" as used in the claims, means "at least one."

Figure 2:
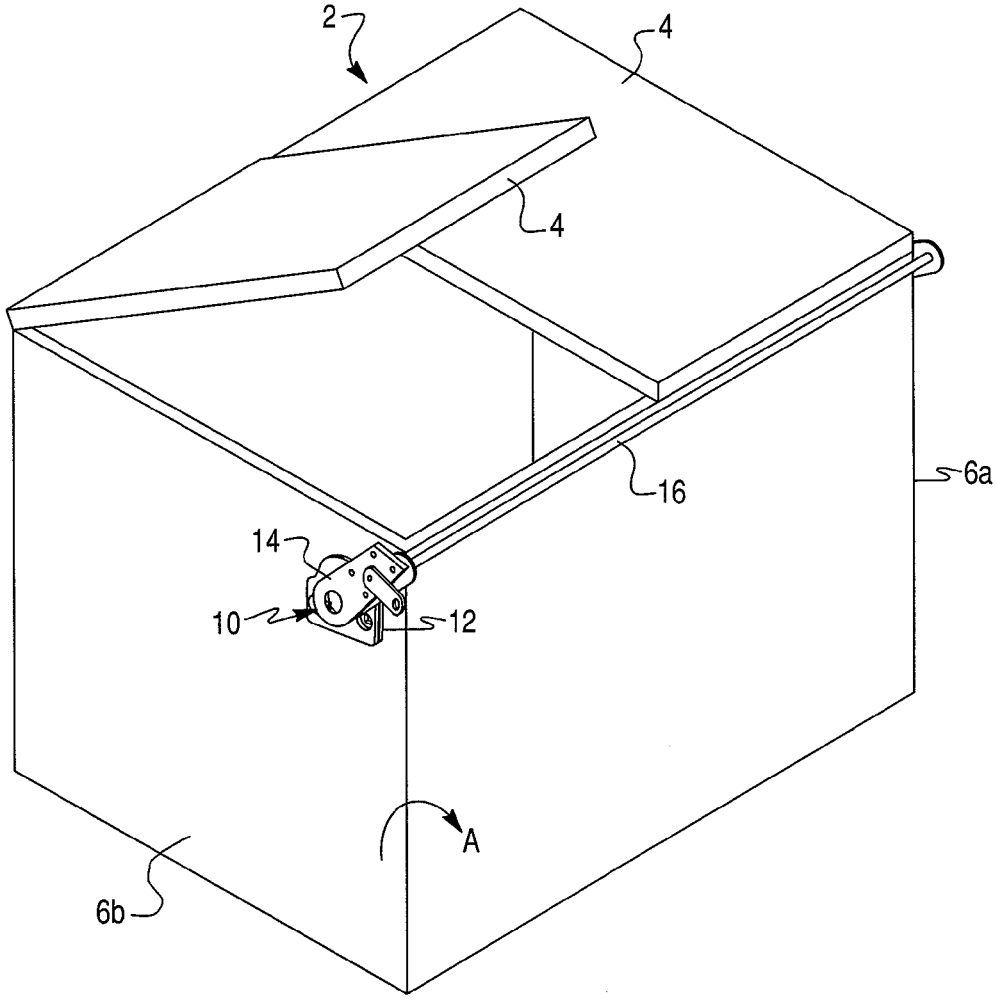
FIG. 2 is a perspective view of the waste container with the locking device according to the present invention, shown in an open position.

FIG. 1 of the drawings illustrates a waste or storage container 2, such as a trash collector, having one or, preferably, two hinged lids 4, a safety locking device 10 and a locking bar 16 extending substantially across the length of the waste container 2, as illustrated in FIGS. 1 and 2. The locking device 10 is provided for locking and unlocking the dumpster 2 to prevent the inadvertent dumping of its contents. The locking bar 16 extends between the locking device 10 at one end and a pivoting bar 8 at the other end thereof. The pivoting bar 8 is pivotally fixed to a right side wall 6*a* of the waste container 2. The waste container 2, as illustrated in FIG. 1, is generally an industrial-type dumpster used for retaining, storing, and eventually disposing of refuse (waste), such as glass fragments produced during the manufacture of automotive glass. The container 2 may be tilted or otherwise pivoted from an upright storage position (wherein the waste container 2 is sitting generally horizontally) (shown in FIG. 1) to a tilted or dumping position.

Figure 3:
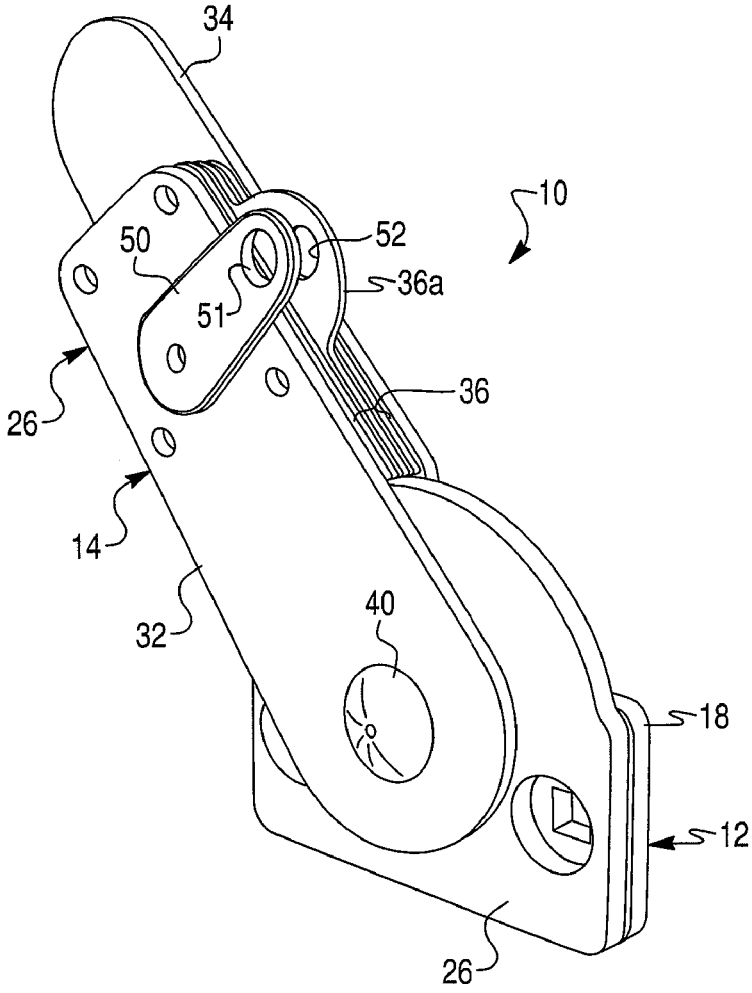
FIG. 3 is a perspective view of the locking device according to the preferred embodiment of the present invention, shown in the closed position.
Figure 4:
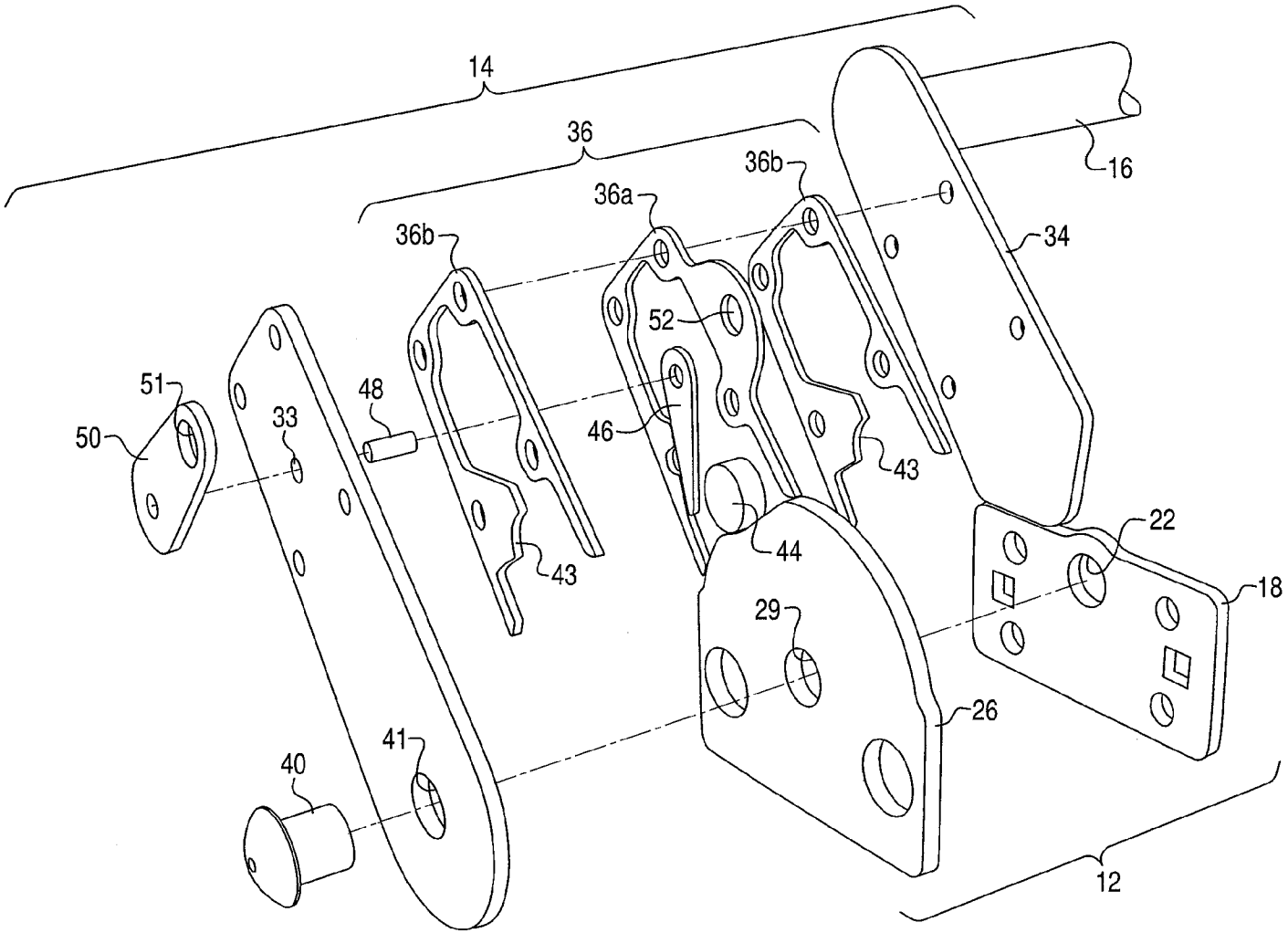
FIG. 4 is an exploded perspective view of the locking device according to the preferred embodiment of the present invention.
Figure 5:
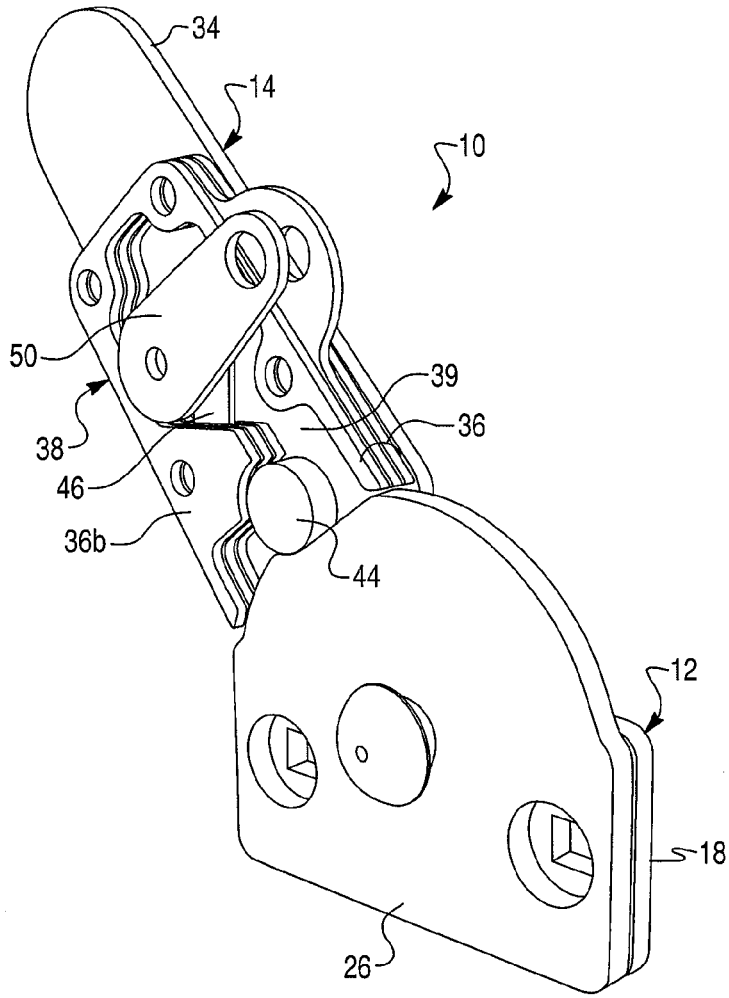
FIG. 5 is a perspective view of the locking device according to the preferred embodiment of the present invention, shown in the closed position, without a cover plate.

The locking device 10, as illustrated in detail in FIGS. 3-5, comprises a base unit 12 fixed to a left side wall 6*b* of the waste container 2, and an elongated pivoting unit 14 pivotally mounted to the base unit 12. The locking bar 16 is secured to the pivoting unit 14 at a distal end thereof so as to extend substantially across the length of the waste container 2, as illustrated in FIGS. 1 and 2. The pivoting unit 14, the pivoting bar 8 and the locking bar 16 movable therewith are provided to translate from a closed position (shown in FIG. 6) of the waste container 2 wherein the locking bar 16 extends over the hinged lid 4 of the waste container 2 so as to prevent opening of the waste container 2, as illustrated in FIG. 1, and an open position (shown in FIG. 7) wherein the locking bar 16 is horizontally spaced away from the hinged lid 4 of the waste container 2 so as to allow the opening of the waste container 2, as illustrated in FIG. 2.

Figure 8:
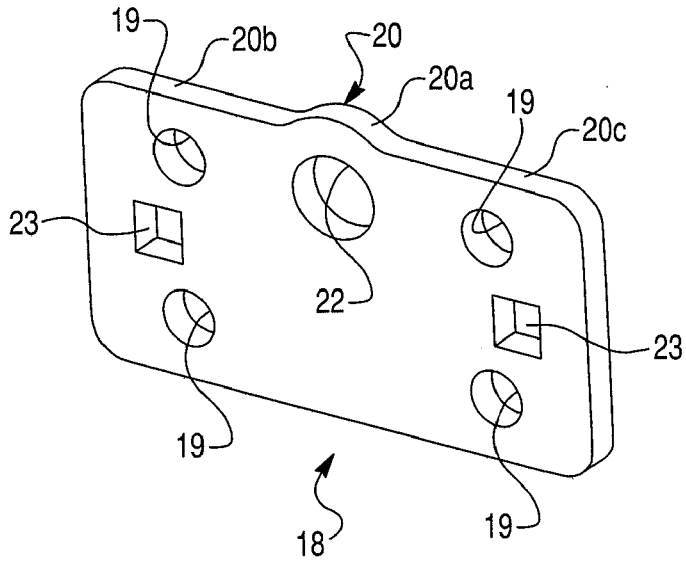
FIG. 8 is a perspective view of a base plate of the locking device according to the preferred embodiment of the present invention.
Figure 9:
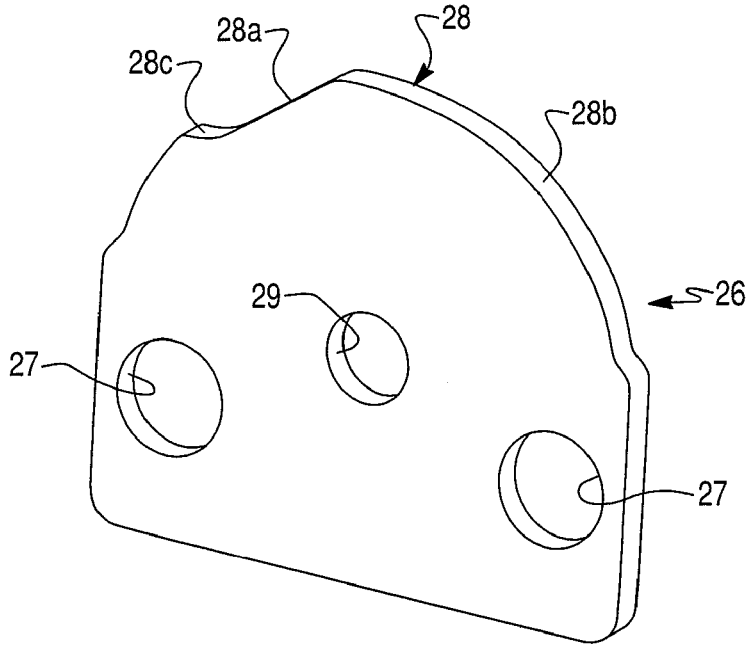
FIG. 9 is a perspective view of a trigger plate of the locking device according to the preferred embodiment of the present invention.

The base unit 12 includes a base member (or base plate) 18 fastened to the left side wall 6*b* of the waste container 2 by any appropriate means known in the art, and a trigger member (or trigger plate) 26 fastened to the left side wall 6*b* of the waste container 2 through the base member 18. Preferably, as illustrated in FIGS. 4 and 8, the base member 18 is in the form of a metal plate fastened to the left side wall 6*b* of the waste container 2 by threaded fasteners (not shown in detail) extending through holes 19 therethrough. As further illustrated in detail in FIGS. 4 and 8, a top edge surface 20 of the base member 18 has a substantially semi-cylindrical cam surface 20*a* and substantially flat surfaces 20*b* and 20*c* extending from the cam surface 20*a*. As illustrated in FIGS. 4 and 9, the trigger member 26 is, preferably, in the form of a metal plate fastened to the sidewall 6 of the waste container 2 by threaded fasteners (not shown in detail) extending through holes 27 therethrough and holes 23 formed through the base member 18 (shown in FIG. 8). As further illustrated in detail in FIGS. 4 and 9, an arched (curved) top edge surface 28 of the trigger member 26 has a substantially flat (or planar) rolling surface 28*a*, a substantially cylindrical convex cam surface 28*b* adjacent to the rolling surface 28*a* at one end thereof, and a substantially cylindrical concave cam surface 28*c* adjacent to the rolling surface 28*a* at the other end thereof. Moreover, the rolling surface 28*a* is slanted towards the convex cam surface 28*b* of the trigger member 26 at about 45° angle.

Figure 10:
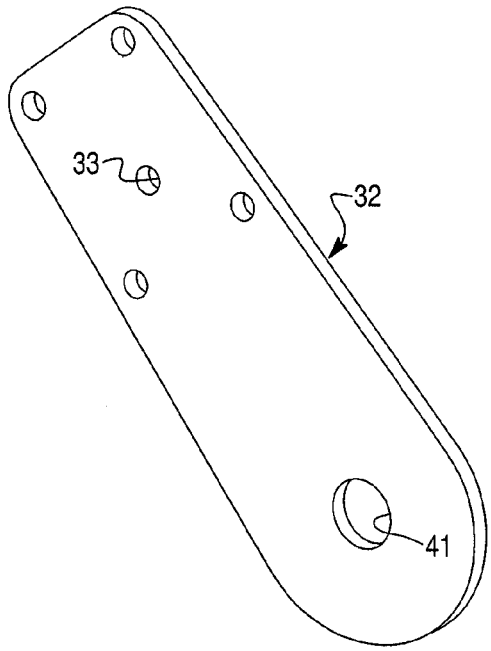
FIG. 10 is a perspective view of the cover plate of the locking device according to the preferred embodiment of the present invention.
Figure 11:
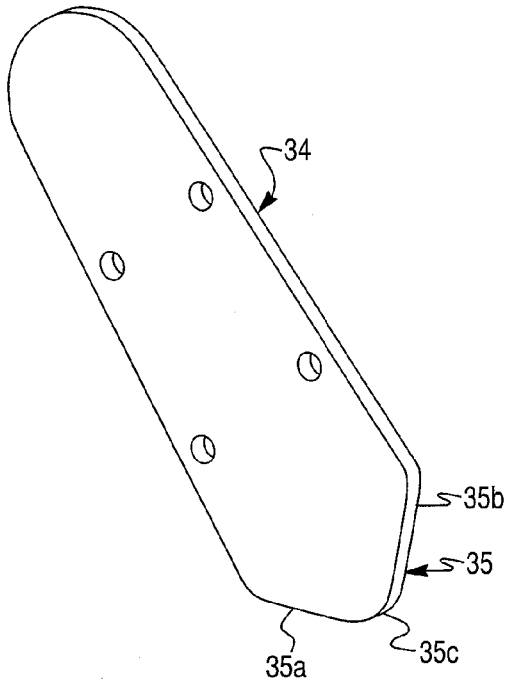
FIG. 11 is a perspective view of an inner plate of the locking device according to the preferred embodiment of the present invention.

The pivoting unit 14 comprises an outer (or cover) plate 32 (shown in FIGS. 3, 4 and 8) pivotally mounted to the base member 18 and the trigger member 26, an inner (extended) plate 34 (shown in FIGS. 3, 4 and 11) fixed to the outer plate 32 through a series of generally U-shaped, hollow plate-shaped members 36 (shown in FIGS. 3, 4 and 10) stacked and fixed together. In other words, the hollow spacer members 36 are sandwiched between the inner plate 34 and the outer plate 32 so as to define a lock housing 38 defining a cavity 39 therein (as shown in FIG. 5). As illustrated in FIGS. 4 and 5, open ends of the generally U-shaped members 36 are facing the base unit 12 so that the arched top edge surface 28 of the trigger member 26 is at least partially received in the cavity 39 of the lock housing 38 of the pivoting unit 14. Preferably, the series of the plate-shaped spacer members 36 comprises a middle plate 36*a* and at least one side spacer plate 36*b* adjacent the middle plate 36*a*. More preferably, as illustrated in FIG. 4, the series of the plate-shaped spacer members 36 comprises the middle plate 36*a* and two substantially identical side spacer plates 36*b* sandwiching the middle plate 36*a* therebetween. As further illustrated in FIGS. 1, 2 and 4, the locking bar 16 is mounted to the inner plate 34 by any appropriate means known in the art to extend over the hinged lid 4 of the waste container 2 in the closed position thereof, as shown in FIG. 1. The outer plate 32 is pivotally mounted to the base unit 12 by a pivot pin 40 extending through openings 41, 29 and 22 in the outer plate 32, the trigger member 26 and the base member 18, respectively, as shown in detail in FIG. 4. Thus, the pivoting unit 14 is mounted to the base unit 12 for pivoting movement between the closed position (shown in FIGS. 1 and 6) and the open position (shown in FIGS. 2 and 7).

Figure 6:
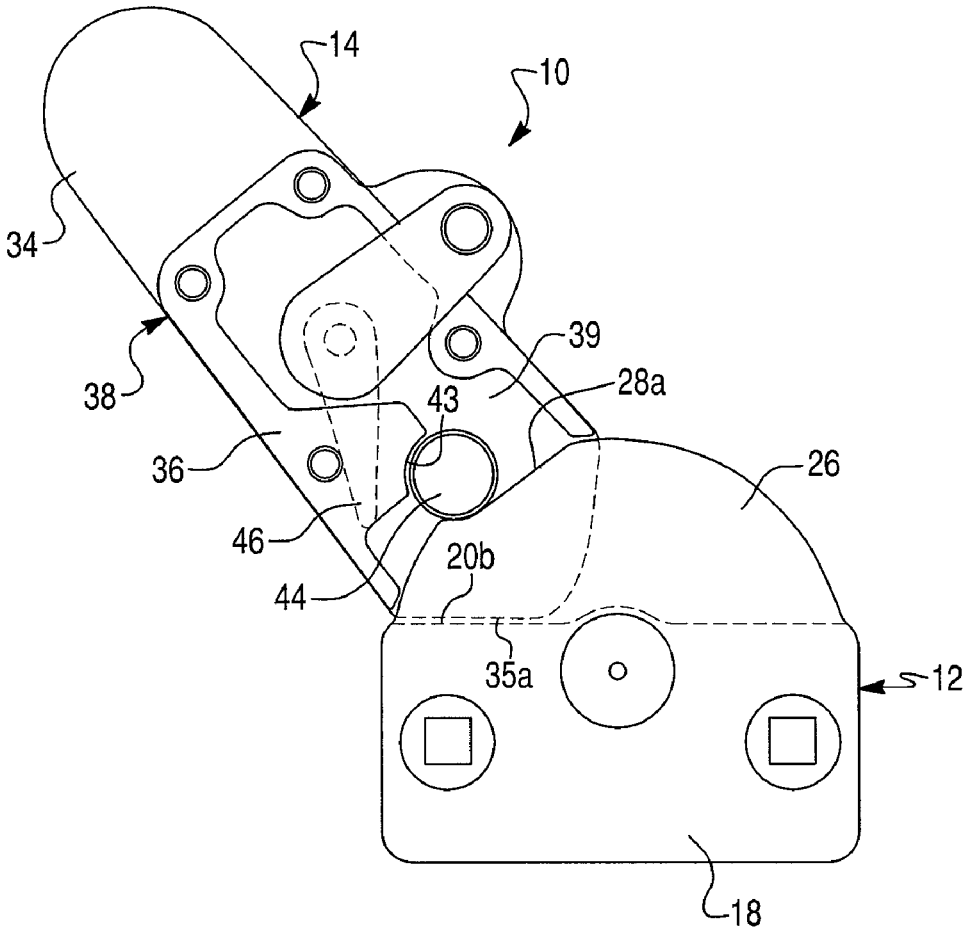
FIG. 6 is a side view of the locking device according to the preferred embodiment of the present invention in the closed position, showing a locking mechanism in a blocking position.
Figure 7:
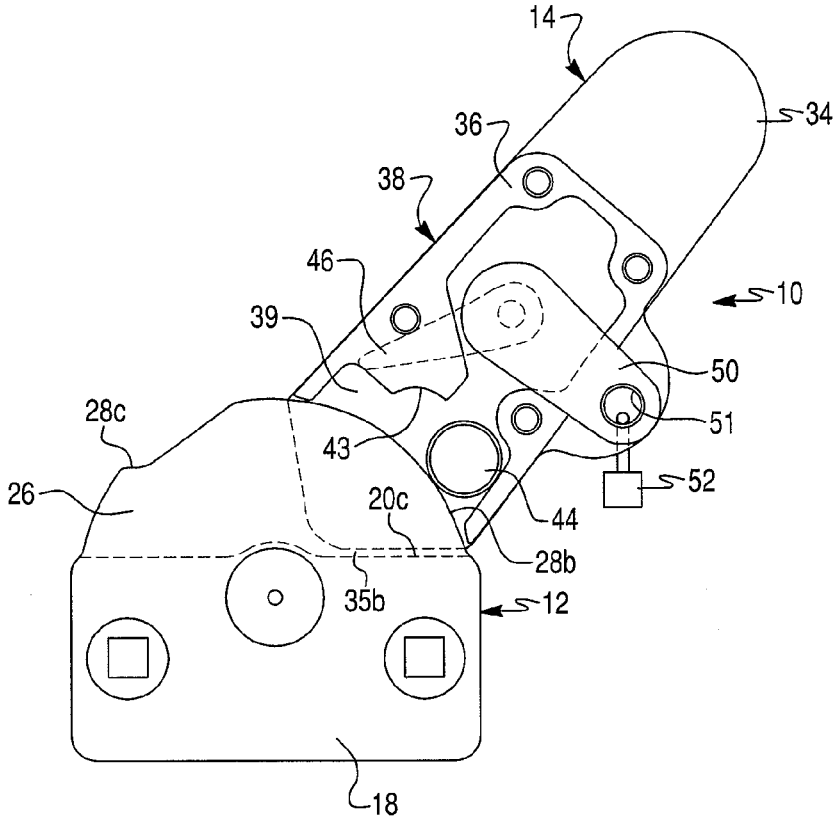
FIG. 7 is a side view of the locking device according to the preferred embodiment of the present invention in the open position, showing the locking mechanism in a release position.

Furthermore, a bottom edge surface 35 of the inner plate 34 has substantially flat first and second edge surfaces 35*a* and 35*b*, respectively, extending from an apex 35*c* thereof at an angle relative to each other. Preferably, the flat edge surfaces 35*a* and 35*b* are oriented at 90° angle relative to each other. It will be appreciated that the first flat edge surface 35*a* of the inner plate 34 engages the flat surface 20*b* of the base member 18 when the pivoting unit 14 is in the closed position (as illustrated in FIGS. 4 and 6), while the second flat edge surface 35*b* of the inner plate 34 engages the flat surface 20*c* of the base member 18 when the pivoting unit 14 is in the open position (as illustrated in FIG. 7). In other words, the first flat edge surface 35*a* of the inner plate 34 acts as a first stop member of the pivoting unit 14 limiting counterclockwise rotation of the pivoting unit 14, and the second flat edge surface 35*b* of the inner plate 34 acts as a second stop member of the pivoting unit 14 limiting clockwise rotation of the pivoting unit 14.

The pivoting unit 14 further includes an automatic, pivoting locking mechanism 42 disposed in the cavity 39 of the lock housing 38. Thus, the locking mechanism 42 is adapted to rotate (pivot) with the pivoting unit 14 of the waste container 2. The locking mechanism comprises a circular rolling member 44 engaging the top edge surface 28 of the trigger member 26, and a pivot (or hinged) lever 46 pivotally mounted within the lock housing 38. Preferably, as illustrated in detail in FIGS. 4, 14A-14C, the circular rolling member 44 is substantially cylindrical in configuration. As further illustrated in FIGS. 4-6, the circular rolling member 44 engages the rolling surface 28*a* and the convex cam surface 28*b* of the top edge surface 28 of the trigger member 26. Moreover, each of the side spacer plates 36*b* has a support flange 37 comprising an arcuate (convex) surface 43. It will be appreciated that each of the arcuate surfaces 43 of the side spacer plates 36*b* as well as the cam surface 28*b* of the trigger member 26 define a radius of curvature that is complementary to (matches) a radius of curvature of the rolling member 44.

According to the present invention, the rolling member 44 is adapted to translate from a first blocking position (shown in FIG. 6) preventing pivoting movement of the pivoting unit 14 relative to the base unit 12 (thus, the locking bar 16 relative to the waste container 2) to a second release position (shown in FIG. 7) permitting pivoting movement of the pivoting unit 14 relative to the base unit 12 (thus, the locking bar 16 relative to the waste container 2). In other words, the rolling member 44 translates from the first blocking position preventing relative movement between the locking mechanism 42 and the base member 18 to the second release position permitting relative movement between the locking mechanism 42 and the base member 18.

Figure 12:
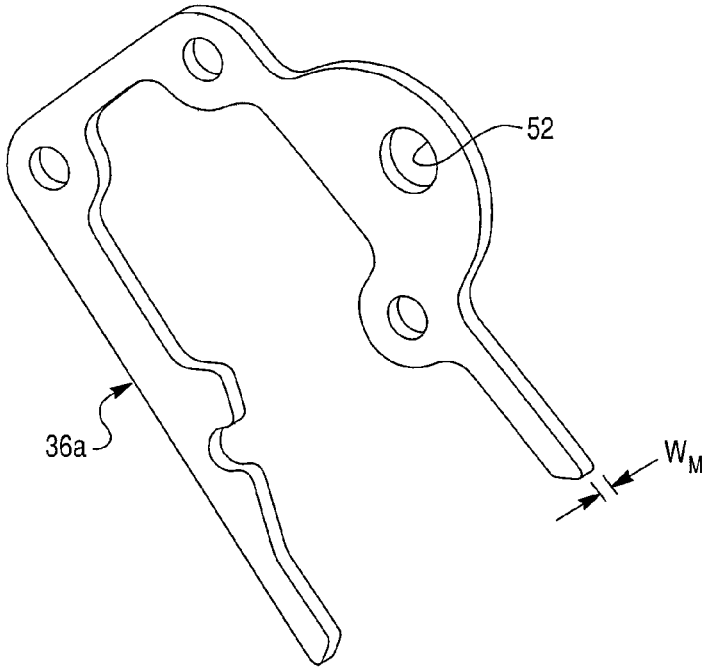
FIG. 12 is a perspective view of a middle plate of the locking device according to the preferred embodiment of the present invention.
Figure 13:
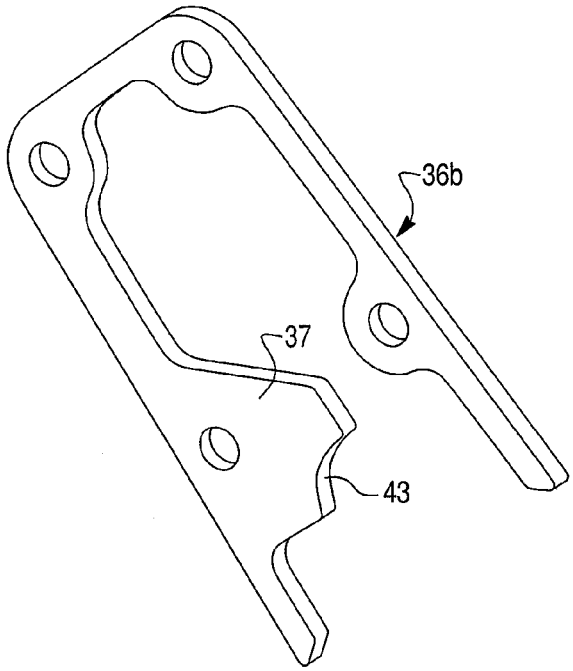
FIG. 13 is a perspective view of a side spacer plate of the locking device according to the preferred embodiment of the present invention.
Figure 14A:
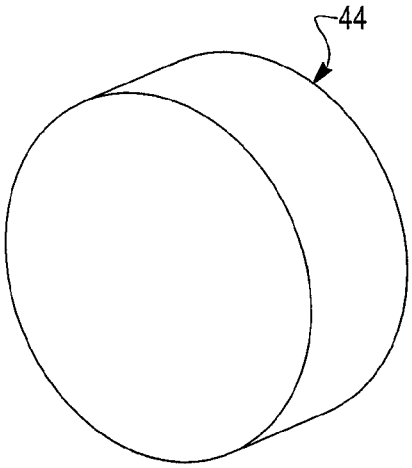
FIG. 14A is a perspective view of a rolling member of a locking mechanism of the locking device according to the preferred embodiment of the present invention.

The locking device 10 is mounted to the waste container 2 so that when the waste container 2 is in its upright storage position, the rolling member 44 is maintained in a far left position thereof (shown in FIG. 6) by gravity. It will be appreciated that a width $W_R$ of the rolling member 44 (shown in FIG. 14C) is bigger than a width $W_M$ of the middle plate 36*a* (shown in FIG. 12). Consequently, in its far left position, the rolling member 44 engages the arcuate surfaces 43 of the side spacer plates 36*b*, as well as the rolling surface 28*a* and the cam surface 28*b* of the trigger member 26. In this position, the rolling member 44 blocks (prevents) the pivoting movement of the pivoting unit 14 relative to the base unit 12. In other words, the rolling member 44 is in the first blocking position (shown in FIG. 6) and prevents the locking bar 16 from rotating relative to the waste container 2, thus maintaining the locking bar 16 in the closed position. However, by tilting the waste container 2 forwardly, in the direction of arrow A, the rolling surface 28*a* of the trigger member 26 becomes generally horizontal and beyond, so that the rolling member 44 rolls to the right as shown in FIG. 7 within the cavity 39 of the lock housing 38 to its second release position and no longer blocks the pivoting unit 14 from rotating relative to the base unit 12. Thus, in the second release position of the rolling member 44, the locking bar 16 can rotate relative to the waste container 2 from the closed position to the open position thereof.

Figure 15:
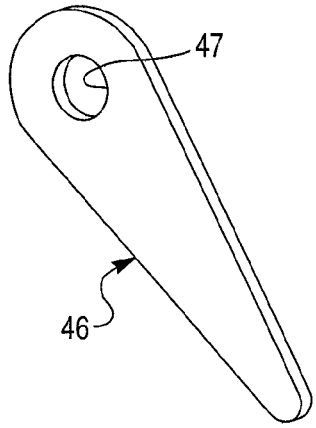
FIG. 15 is a perspective view of a pivot lever of the locking device according to the preferred embodiment of the present invention.
Figure 14B:
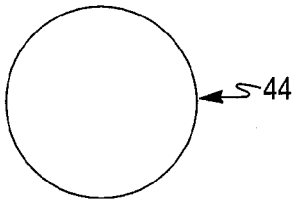
FIG. 14B is a side view of the rolling member of the locking mechanism according to the preferred embodiment of the present invention.
Figure 14C:
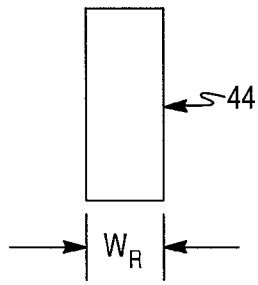
FIG. 14C is a front view of the rolling member of the locking mechanism according to the preferred embodiment of the present invention.

The pivot lever 46 of the locking mechanism 42 is disposed within the lock housing 38 and is pivotally mounted to the outer plate 32 of the pivoting unit 14 through a shaft 48 shown in FIG. 4. Specifically, the shaft 48 extends through a hole 33 in the outer plate 32 so that an inner end of the shaft 48 is received in a hole 47 in the pivot lever 46, shown in detail in FIG. 15, to be non-rotatably fixed thereto. Similarly, an outer end of the shaft 48 is non-rotatably fixed to a manual release lever 50 disposed outside the lock housing 38. In other words, both the pivot lever 46 and the manual release lever 50 are rotatable relative to the outer plate 32 of the pivoting unit 14. It will be appreciated that the rotational movement of the manual release lever 50 causes corresponding rotational movement of the pivot lever 46.

As further illustrated in FIGS. 4 and 5, the pivot lever 46 is disposed and is rotationally moveable in a space defined within the U-shaped middle plate 36*a* between the side spacer plates 36*b* so that a distal end of the pivot lever 46 is located adjacent to the rolling member 44. The pivot lever 46 has a length such that when the rolling member 44 is in the first blocking position, the pivot lever 46 can push the rolling member 44 toward its second release position if rotated counterclockwise (as shown in FIGS. 4-6). Thus, the manual release lever 50 is provided for manually moving the rolling member 44 from the blocking position to the release position regardless of a tilt angle of the locking mechanism 42, as the manual release lever 50 is non-rotatably connected to the pivot lever 46. In other words, the pivot lever 46 allows bypassing the gravity operated locking mechanism 42 by rotating the manual release lever 50 by an authorized person.

In order to prevent rotation of the manual release lever 50 relative to the lock housing 38 by an unauthorized person, a padlock 52 (shown in FIG. 7) may be used. Specifically, the padlock 52 locks together the manual release lever 50 and in one of the three plate-shaped members 36 of the lock housing 38, preferably the middle plate 36*a*, by extending through apertures 51 and 52 therethrough (shown in FIGS. 4 and 12), respectively. It will be appreciated that any type of manual lock device which locks the manual release lever 50 to the lock housing 38 may be employed in order to allow only an authorized person to unlock the manual release lever 50. Thus, the pivot lever 46 has a locked and unlocked position provided by the padlock 52 being placed in the integral holes 51 and 52 in the manual release lever 50 and the p middle plate 36*a*.

In operation, when it is desirable to empty the refuse, the waste container 2 is grabbed by a lifting mechanism of a waste collection truck (not shown), and is moved from the upright storage position to the tilted or dumping position. Initially, the rolling member 44 of the gravity operated locking mechanism 42 is in the first blocking position (as shown in FIGS. 1 and 6). When the waste container 2 is substantially tipped forward or tilted a predetermined angle, preferably about 45°, the rolling member 44 rolls by gravity from the blocking position to the release position along the rolling surface 28*a* of the trigger member 26. In this position the rolling member 44 no longer causes a wedge condition between the side spacer plates 36*b* of the pivoting unit 14 and the trigger member 26 of the base unit 12, and the pivoting unit 14 is allowed to pivot to its open position. Consequently, the pivoting unit 14 and the locking bar 16 move by gravity from the closed position to the open position thereof (shown in FIG. 2). Sequentially, the lid 4 of the waste container 2 swings open by gravity permitting the contents of the waste container 2 to be emptied. It will be appreciated that the gravity operated locking mechanism 42 operates automatically and independently of locking condition of the manual release lever 50. In other words, when the waste container 2 is tilted, the locking mechanism 42 is open whether the manual release lever 50 is locked with the padlock 52 or not. As the waste container 2 is returned to its initial upright storage position, the lid 4 closes by gravity, then the pivoting unit 14 and the locking bar 16 move by gravity to the closed position, and the rolling member 44 is returned to the blocking position.

Manual release of the rolling member 44 by an authorized person can be achieved the pivot lever 46. When the padlock 52 is in place (i.e. the pivot lever 46 is in the locked position), the movement of the manual release lever 50 (thus the pivot lever 46) is restricted. When the padlock 52 is removed by an authorized person using a designated key, the manual release lever 50 is allowed to pivot at which time the distal end of the pivot lever 46 moves the rolling member 44 to its release position which then allows the pivoting unit 14 with the locking bar 16 to pivot to its open position as shown in FIG. 2.

The foregoing description of the preferred embodiments of the present invention has been presented for the purpose of illustration in accordance with the provisions of the Patent Statutes. It is not intended to be exhaustive or to limit the invention to the precise forms disclosed. Obvious modifications or variations are possible in light of the above teachings. The embodiments disclosed hereinabove were chosen in order to best illustrate the principles of the present invention and its practical application to thereby enable those of ordinary skill in the art to best utilize the invention in various embodiments and with various modifications as are suited to the particular use contemplated, as long as the principles described herein are followed. Thus, changes can be made in the above-described invention without departing from the intent and scope thereof. It is also intended that the scope of the present invention be defined by the claims appended thereto.

What is claimed is:

1. A locking device for a container having a hinged lid, said locking device comprising:

a base unit adapted to be fixed to said container;

a pivoting unit pivotally mounted to said base unit;

said pivoting unit including a locking mechanism mounted therein, said locking mechanism comprising a circular rolling member, said base unit includes a base member and a trigger member both adapted to be fixed to said container, said trigger member having a top surface that has a slanted flat rolling surface provided to engage said rolling member, a substantially cylindrical convex cam surface adjacent to said rolling surface at one end thereof and a substantially cylindrical concave cam surface adjacent to said rolling surface at the other end thereof, said rolling member adapted to roll on said top surface of the trigger member between a blocking position in which said rolling member engages said concave cam surface and said pivoting unit thereby preventing relative movement between said pivoting unit and said base unit and a release position when said container, and thus said base unit, is tilted, permitting relative movement between said pivoting unit and said base unit as said rolling member moves from said concave cam surface to said convex cam surface of said trigger member; and a locking bar fixed to said pivoting unit so as to extend substantially across the length of said container, said locking bar being movable between a closed position wherein said locking bar extends over said hinged lid of said container so as to prevent opening of said container, and an open position wherein said locking bar is spaced away from said hinged lid of said container so as to allow the opening of said container.

2. The locking device according to claim 1, wherein said rolling member translates from said blocking position to said release position by gravity when said container is tilted a predetermined angle.

3. The locking device according to claim 1, wherein said pivoting unit comprises a series of plate-shaped members stacked and fixed together so as to form a lock housing; said locking mechanism is disposed within said lock housing.

4. The locking device according to claim 3, wherein said series of plate-shaped members includes a middle plate and at least one spacer plate adjacent said middle plate; said at least one spacer plate comprises an arcuate surface defining a radius of curvature complementary to a radius of curvature of said rolling member.

5. The locking device according to claim 4, wherein said rolling member has a thickness larger than a thickness of each of said middle plate and said at least one spacer plate.

6. The locking device according to claim 3, wherein said pivoting unit further comprises an outer cover plate pivotally mounted to said base unit; said outer cover plate is fixed to said series of said plate-shaped members.

7. The locking device according to claim 6, wherein said pivoting unit further comprises an inner plate fixed to said outer cover plate so as to sandwich said series of said plate-shaped members therebetween.

8. The locking device according to claim 7, wherein said locking bar is fixed to said inner plate.

9. The locking device according to claim 1, further comprising a pivot lever provided to engage said rolling member in said blocking position to push said rolling member out of said blocking position toward said release position.

10. The locking device according to claim 9, further comprising a manual release lever non-rotatably connected to said pivot lever for manually moving said pivot lever against said rolling member to move said rolling member from said blocking position to said release position regardless of a tilt angle of said locking mechanism.

11. The locking device according to claim 1, further comprising a manual release lever rotatably mounted to said pivoting unit for manually moving said rolling member from said blocking position to said release position regardless of a tilt angle of said locking mechanism and a locking device provided for locking said manual release lever to said pivoting unit so as to prevent rotational movement of said manual release lever relative to said pivoting unit.

12. A locking device for a container having a hinged lid and a locking bar preventing opening of said hinged lid, said locking device comprising:

a trigger member having a flat rolling surface, said trigger member being adapted to be fixed to said container;

a locking mechanism disposed within said lock housing, said locking mechanism comprising a pivot lever and a circular rolling member, said trigger member having a top surface that has a slanted flat rolling surface provided to engage said rolling member, a substantially cylindrical convex cam surface adjacent to said rolling surface at one end thereof and a substantially cylindrical concave cam surface adjacent to said rolling surface at the other end thereof, said rolling member adapted to roll on said top surface of said trigger member between a blocking position in which said rolling member engages said concave cam surface and said lock housing thereby preventing relative movement between said lock housing and said trigger member and a release position when said container, and thus said trigger member, is tilted, permitting relative movement between said lock housing and said trigger member as said rolling member moves from said concave cam surface to said convex cam surface of said trigger member.

13. The locking mechanism according to claim 12, wherein said trigger member closes an opening in said locking housing to retain said rolling member within said locking housing.

14. The locking mechanism according to claim 13, wherein said trigger member is at least partially disposed in said lock housing.

15. The locking device according to claim 14, wherein said lock housing is defined by a series of plate-shaped members stacked and fixed together.

16. The locking device according to claim 15, wherein said series of plate-shaped members includes a middle plate and at least one spacer plate adjacent said middle plate; said at least one spacer plate comprises an arcuate surface defining a radius of curvature complementary to a radius of curvature of said rolling member.

17. The locking device according to claim 16, wherein said rolling member has a thickness larger than a thickness of each of said middle plate and said at least one spacer plate.

18. The locking device according to claim 15, wherein said lock housing is further defined by an outer cover plate pivotally mounted to said trigger member and an inner plate fixed to said outer cover plate so as to sandwich said series of said plate-shaped members therebetween.

19. The locking device according to claim 12, further comprising a manual release lever for manually moving said rolling member from said blocking position to said release position regardless of a tilt angle of said locking mechanism.

20. The locking device according to claim 19, wherein said manual release lever is non-rotatably connected to said pivot lever for manually moving said pivot lever against said rolling member to move said rolling member from said blocking position to said release position regardless of a tilt angle of said locking mechanism.

* * * * *